United States Patent [19]

Yamada

[11] 4,455,911

[45] Jun. 26, 1984

[54] ELECTRONIC MUSICAL INSTRUMENT OF FREQUENCY MODULATION TONE SYNTHESIS TYPE

[75] Inventor: Shigeru Yamada, Hamamatsu, Japan

[73] Assignee: Nippon Gakki Seizo Kabushiki Kaisha, Hamamatsu, Japan

[21] Appl. No.: 378,824

[22] Filed: May 17, 1982

[30] Foreign Application Priority Data

Jun. 12, 1981 [JP] Japan ..... 56-86977

[51] Int. Cl.[3] ..... G10H 1/14

[52] U.S. Cl. ..... 84/1.19; 84/1.21

[58] Field of Search ..... 84/1.01, 1.19–1.24

[56] References Cited

U.S. PATENT DOCUMENTS

| | | | |
|---|---|---|---|
| 4,018,121 | 4/1977 | Chowning | 84/1.01 |
| 4,253,367 | 3/1981 | Hiyoshi et al. | 84/1.22 |
| 4,297,933 | 11/1981 | Nishimoto | 84/1.01 |
| 4,301,704 | 11/1981 | Nagai et al. | 84/1.22 |

*Primary Examiner*—S. J. Witkowski

*Attorney, Agent, or Firm*—Thompson, Birch, Gauthier & Samuels

[57] ABSTRACT

An electronic musical instrument using FM tone synthesis technology produces a musical tone signal e(t) expressed as $$e(t)=A\cdot\sin[\omega ct+I\cdot\sin\omega mt],$$

where A I, ωct and ωmt represent an amplitude information, a modulation index information, a carrier frequency information and a modulation frequency information, respectively. The carrier frequency information ωct and the modulation frequency information ωmt are related to a pitch of a depressed key of the electronic musical instrument. A modulation ratio controller is further provided in the instrument. The modulation ratio controller varies the modulation ratio ωc:ωm of the carrier frequency information ωct to the modulation frequency information ωmt in accordance with the pitch of the depressed key. Such a musical tone having different harmonic constructions according to the tone pitches as that of a pipe organ is implemented by this variation of the modulation ratio.

9 Claims, 1 Drawing Figure

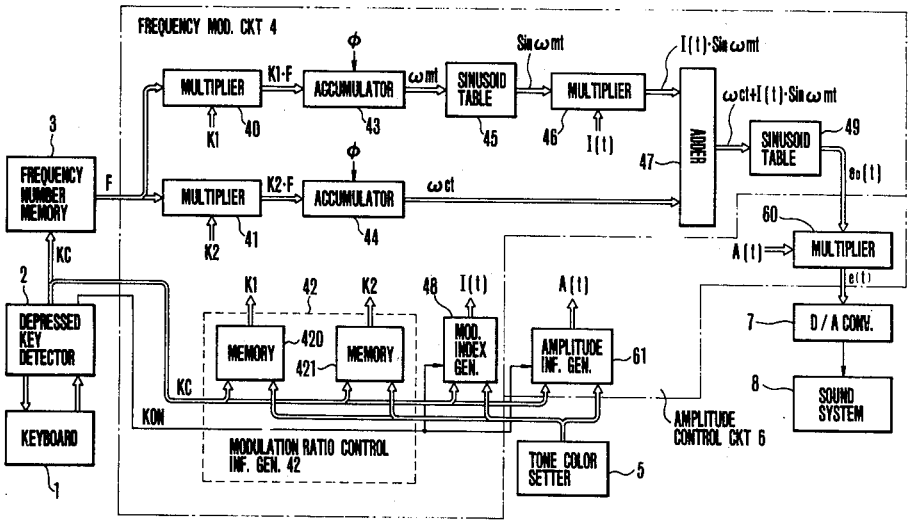

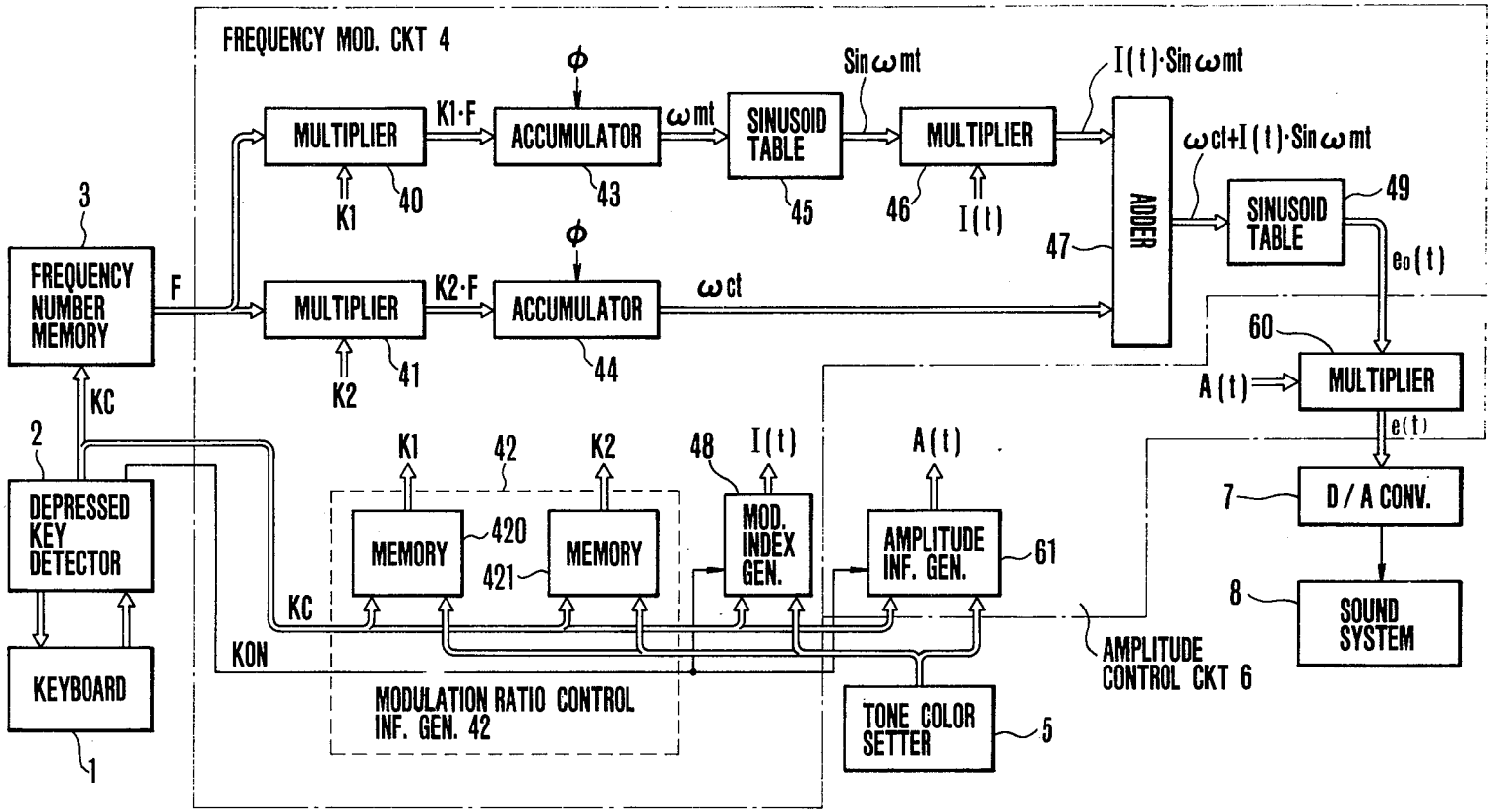
FREQUENCY MOD. CKT 4
MULTIPLIER
K1·F
K1
40
ACCUMULATOR
43
ωmt
SINUSOID TABLE
45
Sinωmt
MULTIPLIER
46
I(t)
I(t)·Sinωmt
ADDER
47
ωct+I(t)·Sinωmt
SINUSOID TABLE
49
e0(t)
MULTIPLIER
K2·F
K2
41
ACCUMULATOR
44
ωct
MULTIPLIER
60
A(t)
e(t)
D / A CONV.
7
SOUND SYSTEM
8
AMPLITUDE CONTROL CKT 6
AMPLITUDE INF. GEN.
61
A(t)
TONE COLOR SETTER
5
MOD. INDEX GEN.
48
I(t)
MEMORY
421
K2
MEMORY
420
K1
42
MODULATION RATIO CONTROL INF. GEN. 42
KC
KON
FREQUENCY NUMBER MEMORY
3
F
KC
DEPRESSED KEY DETECTOR
2
KEYBOARD
1

ELECTRONIC MUSICAL INSTRUMENT OF FREQUENCY MODULATION TONE SYNTHESIS TYPE

BACKGROUND OF THE INVENTION

This invention relates to an electronic musical instrument and more particularly an improvement of an electronic musical instrument which forms a musical tone by utilizing a frequency modulation system.

A frequency modulation tone synthesis type electronic musical instrument has been known in which an instantaneous amplitude value e(t) of a signal to be frequency-modulated is calculated according to the following equation and the calculated instantaneous amplitude value e(t) is used as a musical tone signal.

$$e(t)=A\cdot\sin(\omega ct+I\cdot\sin\omega mt) \quad (1)$$

where A represents an amplitude information, I represents a modulation index formation, ωct and ωmt represent a carrier frequency and modulation frequency informations corresponding to the note pitch of a depressed key, respectively.

In a musical instrument, such as a pipe organ, the harmonic tone construction of a produced musical tone differs in the high tone range and the low tone range thus producing musical tones of different tone colors.

However, in the electronic musical instrument of the frequency modulation type described above, since the ratio ωc/ωm of the carrier angular frequency ωc to the modulation angular frequency ωm (hereinafter called a frequency modulation ratio) was set corresponding to only the type of the tone color, the harmonic tone construction does not differ in the high tone range and the low tone range of the musical tone so that it has been difficult to produce a natural musical tone having different harmonic tone constructions in the high and low tone ranges as in a pipe organ.

SUMMARY OF THE INVENTION

Accordingly, it is an object of this invention to provide an improved electronic musical instrument of the frequency modulation tone synthesis type capable of producing a musical tone having different harmonic tone constructions depending upon the note ranges of the depressed keys.

According to this invention, this object is accomplished by providing a modulation ratio control information generating circuit which generates a modulation ratio control information whose value varies in accordance with the note range of a depressed key so as to vary the frequency modulation ratio ωc/ωm according to the modulation ratio control information.

According to this invention there is provided an electronic musical instrument of the type wherein a musical tone signal e(t) is formed according to an equation $$e(t)=A\cdot\sin(\omega ct+I\cdot\sin\omega mt)$$

where A represents an amplitude information, I represents a modulation index information, and ωct and ωmt represent a carrier frequency information and a modulation frequency information which are related to a note pitch of a depressed key of the electronic musical instrument. The electronic musical instrument includes a modulation ratio control information generator which generates a modulation ratio information whose value varies with a note range of the depressed key, and means for varying at least one of the informations ωct and ωmt in accordance with the modulation ratio control informations.

BRIEF DESCRIPTION OF THE DRAWING

In the accompanying drawing a single FIGURE is a block diagram showing one embodiment of the electronic musical instrument according to this invention.

DESCRIPTION OF THE PREFERRED EMBODIMENT

A preferred embodiment of the electronic musical instrument according to this invention shown in the accompanying drawing comprises a keyboard 1, a depressed key detector 2, a frequency number memory device 3, a frequency modulation circuit 4, a tone color setter 5, an amplitude control circuit 6, a digital/analog converter 7 and a sound system 8 as its major component elements.

When a key of the keyboard 1 is depressed, the depressed key detector 2 detects the depressed key and outputs a key code KC and a key-on signal KON, the key code KC identifying the depressed key and the key-on signal KON showing that the key is depressed. In this embodiment, the key code KC is constituted by an octave code OC representing the octave that the depressed key belongs to and a note code representing the note name thereof. The key code KC is applied to the frequency number memory device 3 to act as an address signal for reading out a frequency number (numerical data) corresponding to the depressed key. The key code KC is also applied to the frequency modulation circuit 4 and the amplitude control circuit 6 to cause them to generate modulation ratio control informations K1 and K2 and an amplitude information A(t) respectively corresponding to the note range of the depressed key.

The frequency number memory device 3 stores frequency numbers F corresponding to the note pitches of respective keys of the keyboard 1 in respective addresses. Consequently, when supplied with a key code KC corresponding to the depressed key from the depressed key detection circuit 2, the frequency number memory device 3 outputs a frequency number F corresponding to the note pitch of the depressed key. The frequency number thus outputted is supplied to multipliers 40 and 41 of the frequency modulation circuit 4.

The multiplier 40 is provided for the purpose of changing the frequency number F utilized to form the modulation frequency information ωmt in accordance with the tone color and the note range of the depressed key. One input of the multiplier 40 is supplied with a modulation ratio control information K1 from a memory device 420 of a modulation ratio control information generator 42.

The multiplier 41 is provided for the purpose of changing the frequency number F utilized to form the carrier frequency information ωct in accordance with the tone color and the note range of the depressed key. One input thereof is supplied with a modulation ratio control information K2 from a memory device 421 of the modulation ratio control information generator 42.

The modulation ratio control informations K1 and K2 correspond to tone colors set by the tone color setter 5 and are outputted from the memory devices 420 and 421 respectively as numerical data informations corresponding to the note range of the depressed key.

More particularly, the memory device 420 has memory blocks of a number corresponding to that of the kinds of the selectable tone colors. Each memory block comprises memory areas of a number corresponding to the number of the octave note ranges of the keyboard 1. Each memory areas stores a modulation ratio control information K1 corresponding to the tone color of a given memory block and to an octave. The memory device 421 has the same construction as memory device 420, and each memory areas thereof stores a modulation ratio control information K2 corresponding to a tone color and an octave. As a consequence, when supplied with a tone color information from the tone color setter 5 and a key code KC as an address signal, the memory devices 420 and 421, respectively, output modulation ratio control informations K1 and K2 corresponding to set tone colors and the note ranges of the depressed keys.

Consequently, the frequency number F corresponding to the note pitch of the depressed key is multiplied in the multipliers 40 and 41 by the modulation ratio control informations K1 and K2, respectively. The output frequency numbers K1·F and K2·F from multipliers 40 and 41, respectively, have been modified according to the set tone colors and octaves of the depressed keys.

The modified frequency numbers K1·F and K2·F are applied to accumulators 43 and 44, respectively.

The accumulator 43 sequentially accumulates the frequency number K1·F supplied from the multiplier 40 according to a clock pulse $\phi$ having a predetermined period, for producing an accumulated value q×K1·F (q=1, 2, 3 . . . ) as the modulation frequency information ωmt. The accumulator 44 sequentially accumulates the frequency number K2·F supplied from the multiplier 41 in synchronism with the clock pulse $\phi$ for outputting its accumulated value q×K2 F (q=1, 2, 3 . . . ) as the carrier frequency information ωct. In this case, since the frequency numbers K1·F and K2·F are changed in accordance with the set tone colors and the octave of the depressed keys, the accumulators 43 and 44, respectively, output the modulation frequency information ωmt and the carrier frequency information ωct corresponding to the note pitch of the depressed key and varying depending upon the note range of the depressed key and the set tone color.

The modulation frequency information ωmt outputted from the accumulator 43 is supplied to a sinusoid memory device 45 as an address signal, while the carrier frequency information ωct outputted from the accumulator 44 is applied to an adder 47.

The sinusoid memory device 45 stores sine amplitude values at respective sampling points in one period of a sine waveform in its respective address. Consequently, when a modulation frequency information is supplied as an address signal, the sinuoid memory device 45 produces an instantaneous amplitude value sin ωmt of a modulation signal having the repetition frequency of the modulation frequency information ωmt, and this instantaneous amplitude value sin ωmt is supplied to a multiplier 46.

The multiplier 46 multiplies the modulation signal sin ωmt with the modulation index information I(t). In this embodiment, a modulation index information I(t) corresponding to the set tone color and to the note range of the depressed key is applied to the multiplier 46 from a modulation index generator 48. More particularly, the modulation index generator 48 is supplied with an information representing the set tone color from the tone color setter 5 and a key code KC representing the depressed key from the depressed key detection circuit 2, the information and the key code KC acting as address signals. When a key-on signal KON is supplied, the modulation index generator 48 produces a modulation index information I(t) which varies with time according to the note range of the depressed key and the set tone color in synchronism with the building up of the key-on signal KON. Consequently, the multiplier 46 produces a modulated signal I(t)·sin ωmt, the instant amplitude value sin ωmt multiplied with the modulation index information I(t) which varies with time. The modulation signal I(t) sin ωmt is supplied to the adder 47.

The purpose of the adder 47 is to modulate the carrier frequency information ωct with the modulation signal I(t)·sin ωmt. When supplied with the information ωct and the signal I(t)·sin ωmt, the adder 47 adds these signals for producing their sum as a modulated frequency information [ωct+I(t) sin ωmt] which is applied to the sinusoid memory device 49 to act as an address signal.

Similar to the sinusoid memory device 45 described above, another sinusoid memory device 49 stores sine amplitude values sin ωt at respective sampling points in one period of a sine waveform in its respective addresses. Consequently, when the modulated frequency information [ωct+I(t)·sin ωmt] is supplied to the sinuoid memory device 49 as an address signal, it produces a frequency modulation signal $e_0(t)$ expressed by $$e_0(t)=\sin(\omega ct+I(t)\cdot\sin\omega mt)$$

The frequency modulated signal $e_0(t)$ thus obtained is applied to the amplitude control circuit 6 to set and control the amplitude. Thus, the frequency modulated signal $e_0(t)$ is applied to a multiplier 60 where it is multiplied by an amplitude setting information A(t) supplied from an amplitude information generator 61. In this case, the amplitude setting information A(t) is generated by the generator 61 in synchronism with the building up of the key-on signal KON and varies with time according to the set tone color and the note range of the depressed key. Consequently, the amplitude of the frequency modulated signal $e_0(t)$ would be set by an amplitude setting information A(t) which varies with time according to the set tone color and the note range of the depressed key.

The frequency modulated signal $$e(t)=A(t)\cdot\sin[\omega ct+I(t)\cdot\sin\omega mt]$$

whose amplitude has been set and controlled in a manner as above described is converted into an analog signal by the digital to analog converter 7 and then supplied to the sound system 8 to be produced as a musical tone.

The frequency numbers K1·F and K2·F which were utilized to form the modulation frequency information ωmt and the carrier frequency information ωct have been changed for respective note ranges of the depressed keys by the modulation ratio control informations K1 and K2, respectively. For example, where the modulation ratio control informations K1 and K2 are set as shown in the following Table with reference to a given tone color in the respective octave ranges for note piches in the range of C2 through C7, the ratio of informations ωct to ωmt varies as 1:6, 1:5, 1:4 . . . in the respective note ranges of the depressed keys corresponding to the ratio of the informations K2 to K1.

TABLE 1

| key range | C2 to C3 | C#8 to C4 | C#4 to C5 | C#5 to C6 | C#6 to C7 |
|---|---|---|---|---|---|
| K1 | 6 | 5 | 4 | 4 | 4 |
| K2 | 1 | 1 | 1 | 1 | 1 |
| ωet:ωmt | 1:6 | 1:5 | 1:4 | 1:4 | 1:4 |

Consequently the harmonic construction of the frequency modulated signal e(t), that is the musical tone signal e(t) varies according to the note range of the depressed key. In other words, it is possible to produce musical tones having different tone colors depending upon the note range.

Although in this embodiment, both modulation ratio control informations K1 and K2 are varied in accordance with the note ranges of the depressed keys, the same object can be accomplished by varying either one of them.

Furthermore, although in the foregoing embodiment the note ranges of the depressed keys were divided for respective octave units, the note ranges may be divided for a plurality of octave units, or for one half octave unit or for each three keys . . . and the like.

Furthermore, instead of varying the modulation index information I(t) and the amplitude setting information A(t) in accordance with the note ranges of the depressed keys, these informations may be fixed.

Although, in the foregoing embodiment the invention was applied to an electronic musical instrument of a monophonic construction, it will be clear that the invention is also applicable to an electronic musical instrument of the polyphonic construction having a tone production assignment unit.

As above described, according to this invention, it is possible to produce any desired musical tone having different harmonic construction according to the note ranges of the depressed keys. The musical tone produced has a naturality which closely resembles the tone produced by such musical instrument as a pipe organ.

What is claimed is:

1. An electronic musical instrument for synthesizing a musical tone signal e(t) expressed as:

$$e(t)=A \sin [\omega ct+I \sin \omega mt]$$

where A represents an amplitude information, I represents a modulation index information, and ωct and ωmt represent a carrier frequency information and a modulation frequency information which are related to a note pitch of a depressed key of the electronic musical instrument comprising: keyboard means having a plurality of keys; a modulation radio control information generator for generating a modulation ratio information whose value varies in accordance with a pitch of the depressed key among said plurality keys; and means for varying at least one of said informations ωct and ωmt in accordance with said modulation ratio control information.

2. An electronic musical instrument according to claim 1 which further comprises a tone color setting means for setting one of a plurality of predetermined tone colors, and wherein said modulation ratio control information differs for each of said tone colors.

3. An electronic musical instrument according to claim 1 wherein said amplitude information A and said modulation index information I are respectively related to a tone color information and a depressed key information.

4. An electronic musical instrument according to claim 1 wherein said modulation ratio control information generator comprises at least two memory devices, each of which stores a modulation ratio control information determined by an octave range in which a depressed key belongs and a set tone color.

5. An electronic musical instrument comprising:

keyboard means having a plurality of keys;

detecting means for detecting a depressed key among said plurality of keys and outputting a key information representing a pitch of said depressed key;

tone signal generating means for generating a musical tone signal e(t) expressed as $e(t)=A\cdot\sin(\omega ct+I\cdot\sin \omega mt)$ in response to said key information where A, I, ωct and ωmt represent an amplitude information, a modulation index information, a carrier frequency information and a modulation frequency information, respectively;

modulation ratio varying means for supplying modulation ratio information corresponding to said key information to said tone signal generating means and varying the modulation ratio defined by the ratio ωc: ωm of said carrier frequency information ωct to said modulation frequency information ωmt, whereby said musical tone signal has different harmonic construction in accordance with a pitch of the tone to be produced.

6. An electronic musical instrument according to claim 5 which further comprises:

tone color setting means for setting one of a plurality of predetermined tone colors and wherein said modulation ratio information corresponds to said set tone color.

7. An electronic musical instrument according to claim 5 wherein said amplitude information A and said modulation index information I correspond to said key information.

8. An electronic musical instrument according to claim 5 wherein said modulation varying means varies said carrier frequency information in accordance with said modulation ratio information, whereby said modulation ratio varies in accordance with the pitch of a tone to be produced.

9. An electronic musical instrument according to claim 5 wherein said modulation varying means varies said modulation frequency information in accordance with the pitch of a tone to be produced, whereby said modulation ratio varies in accordance with the pitch of a tone to be produced.

* * * * *